US011078814B2

(12) United States Patent
Stolk et al.

(10) Patent No.: US 11,078,814 B2
(45) Date of Patent: Aug. 3, 2021

(54) VALVE DRIVE DEVICE, IN PARTICULAR FOR AN INTERNAL COMBUSTION ENGINE OF A MOTOR VEHICLE, AND METHOD FOR OPERATING SUCH A VALVE DRIVE DEVICE

(71) Applicant: Daimler AG, Stuttgart (DE)

(72) Inventors: Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/770,891

(22) PCT Filed: Nov. 27, 2018

(86) PCT No.: PCT/EP2018/082680
§ 371 (c)(1),
(2) Date: Jun. 8, 2020

(87) PCT Pub. No.: WO2019/115219
PCT Pub. Date: Jun. 20, 2019

(65) Prior Publication Data

US 2021/0164369 A1 Jun. 3, 2021

(30) Foreign Application Priority Data

Dec. 11, 2017 (DE) ..... 10 2017 011 402.1

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/047* (2013.01); *H01F 7/081* (2013.01); *H01F 7/17* (2013.01);
(Continued)

(58) Field of Classification Search
CPC ..... F01L 13/0036; F01L 1/047; F01L 2013/0052; F01L 2013/101; H01F 7/17; H01F 7/081
See application file for complete search history.

(56) References Cited

U.S. PATENT DOCUMENTS 8,347,837 B2 * 1/2013 Meintschel ..... F01L 1/46 123/90.15
2010/0126447 A1 5/2010 Talan et al.

FOREIGN PATENT DOCUMENTS

DE 10 2007 054 978 A1 6/2009
DE 10 2008 060 169 A1 6/2010
(Continued)

OTHER PUBLICATIONS

PCT/EP2418/082880, International Search Report dated Feb. 12, 2019 (Two (2) pages).
(Continued)

*Primary Examiner* — Zelalem Eshete
(74) *Attorney, Agent, or Firm* — Crowell & Moring LLP

(57) ABSTRACT

A valve drive device has a camshaft which includes a shaft element and a cam piece which can be driven by the shaft element and a first cam effecting a first stroke of a valve and a second cam effecting a second stroke of the valve, and is displaceable in the axial direction of the camshaft relative to the shaft element between a first position, in which the valve can be actuated by the first cam, and a second position in which the valve can be actuated by the second cam, and has an electrically controllable actuator via which the cam piece is displaceable relative to the shaft element in the axial direction as a result of an electrical control of the actuator. The actuator pushes the cam piece alternately back and forth between the positions in the case of successive electrical controls occurring with the same polarity.

4 Claims, 3 Drawing Sheets

(51) Int. Cl.

| | |
|---|---|
| ***F01L 1/047*** | (2006.01) |
| ***H01F 7/08*** | (2006.01) |
| ***H01F 7/17*** | (2006.01) |

(52) U.S. Cl.
CPC . *F01L 2013/0052* (2013.01); *F01L 2013/101* (2013.01)

(56) References Cited

FOREIGN PATENT DOCUMENTS

| | | |
|---|---|---|
| DE | 10 2014 014 282 A1 | 3/2016 |
| DE | 10 2015 014 175 A1 | 5/2017 |
| DE | 10 2016 001 537 A1 | 8/2017 |

OTHER PUBLICATIONS

German-language German Office Action issued in German application No. 10 2017 011 402.1 dated Aug. 30, 2019 (Seven (7) pages).

* cited by examiner

VALVE DRIVE DEVICE, IN PARTICULAR FOR AN INTERNAL COMBUSTION ENGINE OF A MOTOR VEHICLE, AND METHOD FOR OPERATING SUCH A VALVE DRIVE DEVICE

BACKGROUND AND SUMMARY OF THE INVENTION

The invention relates to a valve drive device, in particular for an internal combustion engine. Furthermore, the invention relates to a method for operating such a valve drive device.

Such a valve drive device, in particular for an internal combustion engine, and such a method for operating such a valve drive device are already known from DE 10 2016 001 537 A1. The valve drive device comprises at least one camshaft, which has at least one shaft element and a cam piece which can be driven by the shaft element. The cam piece is, for example, connected to the shaft element in a rotationally fixed manner, such that when the shaft element is rotated, the cam piece is rotated with the shaft element. If, therefore, the shaft element is, for example, driven by an output shaft of an internal combustion engine, which is designed as a crankshaft, for example, the cam piece is driven by the shaft element and is thereby rotated with the shaft element, for example, around a camshaft axis.

The cam piece has at least one first cam which causes a first stroke of a valve and at least one second cam which causes a second stroke of the valve which is different from the first stroke, wherein the second stroke is, for example, greater than the first stroke or vice versa. The valve is, for example, a gas exchange valve which is assigned, for example, to a combustion chamber, which is designed in particular as a cylinder, of an internal combustion engine designed, for example, as a reciprocating piston engine. Here, the gas exchange valve can be an intake valve or an exhaust valve. The cam piece can be displaced in the axial direction of the camshaft relative to the shaft element between at least one first position and at least one second position. In the first position, the valve can be actuated by means of the first cam, wherein in the second position, the valve can be actuated by means of the second cam. In addition, the valve drive device comprises an electrically controllable actuator by means of which, as a result of a respective electrical control of the actuator, the cam piece can be displaced relative to the shaft element in the axial direction of the camshaft. Such an electrical control means, in particular, a supply of electrical energy or electrical current to the actuator, such that, for example, the actuator is supplied with electrical energy or electrical current within the scope of the respective electrical control.

The object of the present invention is to further develop a valve drive device and a method of the type mentioned above in such a way that a particularly space-saving, cost-effective and functionally reliable actuation of the valve can be implemented.

In order to develop a valve drive device of the type specified herein in such a way that a particularly cost-effective, space-saving and functionally reliable actuation of the valve designed, for example, as a gas exchange valve and, in particular as a poppet valve can be implemented, it is provided in accordance with the invention that the actuator is designed to push the cam piece alternately back and forth between the positions in the case of successive controls with the same, in particular electrical, polarity. In other words, if for example, a first electrical control of the actuator with one electrical polarity takes place first, the cam piece is thereby shifted from the first position to the second position by means of the actuator, for example. If, for example, a second electrical control of the actuator is then carried out with the same electrical polarity as the first electrical control of the actuator, the cam piece is moved from the second position to the first position by means of the actuator. If, for example, a third electrical control of the actuator is then carried out with the same polarity as the first electrical control and the second electrical control, the cam is then moved again from the first position to the second position by means of the actuator, for example. The actuator is thus designed to react differently to repeated electrical controls with identical polarity and to move the cam piece alternately back and forth between the positions. The respective electrical control of the actuator is understood in particular to mean a supply of electrical energy or electrical current to the actuator such that, for example, during the respective electrical control, the actuator is supplied with electrical energy or electrical current, in particular by an electrical control unit. In the case of electrical controls which are carried out with the same electrical polarity, the actuator is, for example, operated in the identical or the same direction of current flow, or electrical current flows in the identical or the same direction of current flow through the electrically controllable and thus electrically operable actuator.

The invention is based in particular on the following finding: in conventional valve drive devices, in order to move the cam piece back and forth between the positions by means of the actuator and thus to displace the cam piece in opposite directions, the successive electrical controls of the actuator must take place with different and in particular opposite or alternating polarities in order to reverse the polarity of the actuator, which is designed as an electric motor for example, and to effect a reversal of the direction of current flow. In contrast to the invention, it is thus conventionally provided, for example, that the first electrical control described above takes place with a second polarity different from the first polarity and in particular opposed to the first polarity or reversed with respect to the first polarity, and the third control, for example, takes place again with the first polarity. Thus, for example, in the course of the first electrical control, electrical current flows through the actuator in a first direction of current flow, wherein, for example, in the course of the second electrical control, electrical energy or electrical current flows through the actuator is a second direction of current flow opposed to the first direction of current flow. In this way, it is possible, for example, if the actuator is designed as an electric motor and thus has a stator and a rotor which can rotate relative to the stator, to effect a reversal of the direction of rotation of the electric motor. This means, for example, that the rotor is rotated in a first direction of rotation opposed to the first direction of rotation by the second electrical control in order to be able to push the cam piece back and forth. This reversal of the direction of current flow takes place, for example, when the control unit reverses the polarity of an electrical voltage applied to the electric motor. Alternatively, it is conceivable that the control unit has two outputs via which the control unit can electrically control the actuator. Via a first of the outputs, for example, the first electrical control with the first polarity is effected, wherein the second electrical control with the second polarity is effected via the second output, for example.

In this way, the reversal of the direction of rotation of the electric motor can also be effected. This conventional way of pushing the cam piece back and forth has the following disadvantages in particular: to reverse the polarity of the voltage for the electric motor, also known as supply voltage, an H-bridge is required in the control unit, in particular in an output stage of the control unit. The manufacture of an output stage with H-bridges is very cost-intensive. A control unit with two outputs for moving the cam piece back and forth is also cost-intensive and requires a lot of installation space. In addition, a faulty control can conventionally occur, whereby, for example, the actuator does not push the cam piece in the second direction during the second electrical actuation described above, but rather tries to push the cam piece further in the first direction. As a result, an actually desired stroke changeover does not occur and/or it results in mechanical damage.

The disadvantages described above can be avoided by means of the valve drive device according to the invention, since the cam piece can be shifted alternately from the first position to the second position and from the second position to the first position by means of the electrical controls with the same polarity. In this way, the installation space required and the costs of the valve drive device can be kept particularly low. In addition, the probability of it resulting in faulty switching can be kept particularly low.

In an advantageous design of the invention, the valve drive device comprises an electronic control unit which has exactly one output for the actuator, via which the successive electrical controls of the actuator with the same polarity take place or can be carried out. Since the actuator always is or can be controlled by the control unit with the identical or the same polarity, the use of an H-bridge in the control unit can also be avoided, such that the control unit can be manufactured at a particularly low cost. In addition, exactly one output is sufficient to push the cam piece back and forth, such that the installation space requirement and the weight of the control unit and thus of the valve drive device as a whole can be kept within a particularly low framework.

In a further embodiment of the invention, the actuator is designed as a linear actuator which can be designed in a substantially more space-saving and cost-effective manner than electric motors which have a stator and a rotor which can be rotated relative to the stator. The linear actuator has, in particular exactly, one coil which can be supplied with electric current by the respective electrical control. In other words, the coil is supplied with electric current by the respective electrical control, with flows through the coil during the respective electrical control. Since the electrical controls occur with the same or similar polarity, the electric current flows through the coil in the same or similar direction of current flow with the electrical controls occurring with the same polarity.

The linear actuator also has, in particular exactly, one armature which can be moved translationally relative to the coil by supplying the coil with electric current via the coil. In other words, if the coil is supplied with electric current such that the electric current flows through the coil, the armature is thereby moved translationally relative to the coil by means of the coil. By supplying the coil with electric current, for example, at least one magnetic field is generated, by means of which the armature is moved translationally relative to the coil. This allows the cam piece to be moved back and forth at low cost and in a space-saving manner. Supplying the coil with electric current causes, for example, a translational movement of the armature relative to the coil in an armature direction, such that the armature is moved translationally in the armature direction by the respective electrical control. Successive movements of the armature in the armature direction caused by the electrical controls move the cam piece alternately back and forth between the positions. By way of example, during the respective movement in the armature direction, the armature moves from a starting position into an actuating position, such that the cam piece is alternately pushed back and forth from the starting position into the actuating position by successive movements of the armature caused by the respective electrical controls. In this way, the installation space required for the valve drive device can be kept particularly small.

A further embodiment is characterized by the fact that the armature is coupled to a control element which can translationally move with the armature relative to the coil. This means that the control element is also moved by the electrical controls from the initial position to the actuating position in succession. The armature is connected to the control element magnetically or by magnetic forces, for example. By using the control element, the pushing back and forth of the cam piece can be implemented in a space-saving and cost effective manner.

In a further design of the invention, the valve drive device comprises a forcing guide by means of which rotations of the control element resulting from translational movements of the control element around a rotational axis can be effected or are effected, wherein the translational movements of the control element result, for example, from the electrical controls and in particular follow these. In other words, if the armature is moved from the starting position to the actuating position by means of the coil in the manner described above, in particular successively in each case, the control element is also moved successively from the starting position to the actuating position, such that the control element is moved translationally in the armature direction. If the respective control then ends, for example, a translational movement of the armature and the control element in a reverse direction opposed to the armature direction takes place, for example before the next electrical control in each case, whereby the armature and with it the control element move, for example, from the actuating position back into the starting position. The forcing guide uses, for example, the respective translational movement of the control element occurring in the reverse direction to cause the control element to rotate around the rotational axis preferably relative to the coil and/or relative to the armature. In other words, the forcing guide transforms the respective translational movement of the control element; in particular occurring in the reverse direction, into a rotation of the control element around the rotational axis, preferably in exactly one direction of rotation. In this way, the back and forth movement of the cam piece can be represented in a space-saving and cost-effective manner.

It has proved to be particularly advantageous here if the actuator has at least one first actuating element and at least one second actuating element, each of which can be moved along an actuating direction in a translational manner towards the camshaft. By way of example, the actuation direction coincides with the armature direction or the actuation direction runs parallel to the armature direction. The armature direction and/or the actuation direction runs, for example, at least substantially perpendicularly or obliquely to the axial direction of the camshaft. The respective actuating element is designed, for example, as a pin element, a pin or a bolt.

Here, the control element alternately actuates the actuating elements during its translational movements caused by the successive electrical controls and as a result of its rotations caused by the forced guidance. In other words, during a first translational movement of the control element, the control element actuates the first actuating element, for example, while the second actuating element is not actuated by the control element. Since the control element is rotated around the rotational axis by means of the forced guidance as a result of the first translational movement, the control element actuates the second actuating element, for example, during a second translational movement following the first translational movement, while the first actuating element is not actuated by the control element. In this way, the cam can be moved back and forth successively or alternately by means of the actuating elements, such that a space-saving, weight-effective and cost-effective stroke switching can be represented. Through the alternating actuation of the actuating elements caused by the control element, the control element moves the actuating elements alternately translationally along the respective actuating direction relative to the camshaft, whereby the control element causes the cam piece to be pushed alternately back and forth. In this way, the cam piece can be easily pushed back and forth by the electrical controls which take place with the same polarity.

A further embodiment is characterized by the fact that the first actuating element has a first actuating surface which runs obliquely to the actuating direction and obliquely to the axial direction of the camshaft. The second actuating element has a second actuating surface which runs obliquely to the actuating direction and obliquely to the axial direction of the camshaft. The first actuating surface and the second actuating surface are arranged, for example, facing each other or on facing sides of the actuating elements.

Furthermore, a sliding element is provided which can be displaced in the axial direction of the camshaft relative to the shaft element, by means of which the cam piece can be displaced relative to the shaft element. For this purpose, the sliding element is coupled, for example, to the cam piece, in particular in a positive-locking manner. If, for example, the sliding element is thus displaced in the axial direction of the camshaft relative to the shaft element, the sliding element takes the cam piece with it such that the cam element is also displaced in the axial direction of the camshaft relative to the shaft element.

The sliding element has a third actuating surface corresponding to the first actuating surface, which runs obliquely to the actuating direction and obliquely to the axial direction of the camshaft. In addition, the sliding element has a fourth actuating surface corresponding to the second actuating surface, which runs obliquely to the actuating direction and obliquely to the axial direction of the camshaft. The third actuating surface and the fourth actuating surface are arranged on opposite sides or point away from each other, for example. The first actuating surface is thereby moveable by actuating the first actuating element in supporting contact with the third actuating surface, whereby the sliding element is displaceable relative to the shaft element in a first sliding direction extending along the axial direction of the camshaft in order to thereby effect a displacement of the cam piece from one of the positions to the other position via the sliding element. The second actuating surface is moveable into supporting contact with the fourth actuating surface by actuating the second actuating element, whereby the sliding element is displaceable relative to the shaft element in a second sliding direction extending along the axial direction of the camshaft and opposite the first sliding direction, in order to thereby effect a displacement of the cam piece from the one position to the other position via the sliding element. The sliding direction thus runs, for example, perpendicularly to the armature direction and/or the actuating direction.

If, for example, the first actuating element is actuated and thereby moved translationally, the first actuating surface comes into supporting contact or direct contact with the third actuating surface, for example, wherein the first actuating surface slides on the third actuating surface or vice versa. As a result, the translational movement of the first actuating element running along the actuating direction is converted into a displacement of the sliding element running along the axial direction of the camshaft and thus of the cam piece, whereby the sliding element and with it the cam piece are displaced in the first sliding direction relative to the shaft element. Meanwhile, the second actuating element is not actuated, in particular by the control element.

If, for example, the second actuating element is then or previously actuated and thereby moved translationally along the direction of actuation, the second actuating surface comes into supporting contact, in particular in direct contact, for example, with the fourth actuating surface, wherein, for example, the second actuating surface slides on the fourth actuating surface or vice versa. Since the actuating surfaces run obliquely to the actuating direction and obliquely to the axial direction or to the sliding direction, the translational movement of the second actuating element running along the actuating direction is converted by means of the second actuating surface and by means of the fourth actuating surface into a displacement of the sliding element running along the sliding direction or along the axial direction. As a result, the sliding element and with it the cam piece are pushed in the second sliding direction opposite the first sliding direction. By displacing the sliding element in the first sliding direction, for example, the cam piece is displaced from one position to another. By displacing the sliding element in the second sliding direction, for example, the cam piece is moved from the other position to the one position. The one position is, for example, the first position, wherein the other position is, for example, the second position. This embodiment enables a particularly space-saving, and cost-effective stroke changeover, which can be carried out sequentially by electrical controls with the same polarity.

In a particularly advantageous embodiment of the invention, the control element has at least one recess which is arranged in overlap or overlay with the first actuating element in at least one first rotational position of the control element rotatable into the first rotational position by means of the forced guidance and in overlap or overlay with the second actuating element in at least one second rotational position, different from the first rotational position, of the control element rotatable into the second rotational position by means of the forced guidance. If, for example, the control element is in the first rotational position and the control element is moved translationally along the armature direction from the initial position into the actuating position via the armature while the control element is in the first rotational position, then, for example, the second actuating element is moved by means of the control element, in particular by means of a wall region of the control element, and thereby moved translationally along the direction of actuation, while, however, the first actuating element is immersed in the recess formed, for example, as a through-opening, whereby an actuation of the first actuating element caused by the control element does not occur.

If, however, the control element is in the second rotational position, and if the control element is moved translationally from the initial position into the actuating position via the armature along the armature direction coinciding, for example, with the actuating direction, while the control element is in the second rotational position, the first actuating element is actuated, for example, by means of the control element, in particular by means of the wall region of the control element, while, however, the second actuating element is immersed in the recess, such that an actuation of the second actuating element caused by the control element does not occur. The respective immersion of the respective actuating element in the recess means in particular that the respective actuating element is arranged at least partially in the recess or engages in the recess, in particular in such a way that, despite the translational movement of the control element, an actuation of the actuation element engaging in the recess caused by the control element does not occur.

The forced guidance can rotate the control element into the respective rotational position as a result of the respective translational movement of the control element. The respective rotation of the control element around the rotational axis caused by the forced guidance and resulting from the translational movement of the control element occurs, for example, during a respective movement of the control element from the actuating position into the starting position, in particular in the reverse direction, wherein, for example, a rotation of the control element caused by means of the forced guidance does not occur when the control element is moved from the starting position into the actuating position.

In order to keep the number of parts, the weight, the installation space required and the costs of the valve drive device particularly low, it is provided in a further development of the invention that the forced guidance comprises the coil which is designed or functions as a spring element. The coil is thereby tensible by the respective translational movement of the control element caused by the respective electrical actuation and is thus rotatable in a first direction of rotation. In other words, for example, if the control element is moved from the initial position into the actuating position by the respective electrical actuation, the coil, which is designed or functions as a spring element, is tensioned, in particular compressed. As a result, the coil, at least while the control element is in the actuating position, provides a spring force which, for example, acts on the control element and is opposed to the direction of actuation. The spring element or the coil relaxes between every two successive electrical controls. In other words, if the respective electrical control is ended, the tensioned coil can at least partially relax after the electrical control is ended and before the start of the next electrical control, whereby, for example, the control element is moved from the actuating position to the initial position by means of the coil or by means of the aforementioned spring force. By way of example, during this respective of the control element from the actuating position to the initial position, the forced guidance causes the control element to be rotated around the rotational axis.

When or by releasing the tension of the coil, the coil rotates automatically in a second direction of rotation opposed to the first direction of rotation, causing the control element to rotate around the rotational axis relative to the camshaft. A rotation of the control element during its movement from the starting position into the actuating position is effected, for example, by the fact that the control element is coupled to or interacts with the coil (spring element) via a freewheel or via a freewheel device. As a result, when the control element is moved from the starting position into the actuating position, for example, a rotation of the control element around the rotational axis relative to the camshaft caused by the forced guidance or by the coil does not occur, although the coil is rotated or twisted in the first direction of rotation during the translational movement of the control element from the starting position into the actuating position. In this case, the freewheel allows a relative rotation between the coil and the control element, for example. In other words, the freewheel opens in the first direction of rotation. However, in the second direction of rotation, the freewheel locks such that when the coil turns back in the second direction of rotation, the coil rotates the control element around the rotational axis relative to the camshaft via the freewheel. In this way, for example, the abovementioned recess can be rotated from actuating element to actuating element such that the actuating element are actuated alternately in the successive electrical controls.

In order to further develop a method of the kind specified herein in such a way that a particularly space-saving, cost-effective and safe actuation of the valve, in particular stroke switching, can be implemented, it is provided in accordance with the invention that the actuator alternately pushes the cam piece back and forth between the positions in the case of successive electrical actuations with the same polarity. Advantages and advantageous designs of the valve drive device according to the invention are to be regarded as advantages and advantageous designs of the method according to the invention and vice versa.

Further advantages, features and details of the invention arise from the following description of a preferred exemplary embodiment and from the drawings. The features and combinations of features mentioned in the description as well as the features and combinations of features mentioned in the following description and/or shown in the Figures alone can be used not only in the combination specified in each case, but also in other combinations or on their own without leaving the scope of the invention.

BRIEF DESCRIPTION OF TRE DRAWINGS

FIG. 1 sectionally, is a schematic and partially cut side view of a valve drive device according to the invention, in particular for an internal combustion engine;

Figure 4:
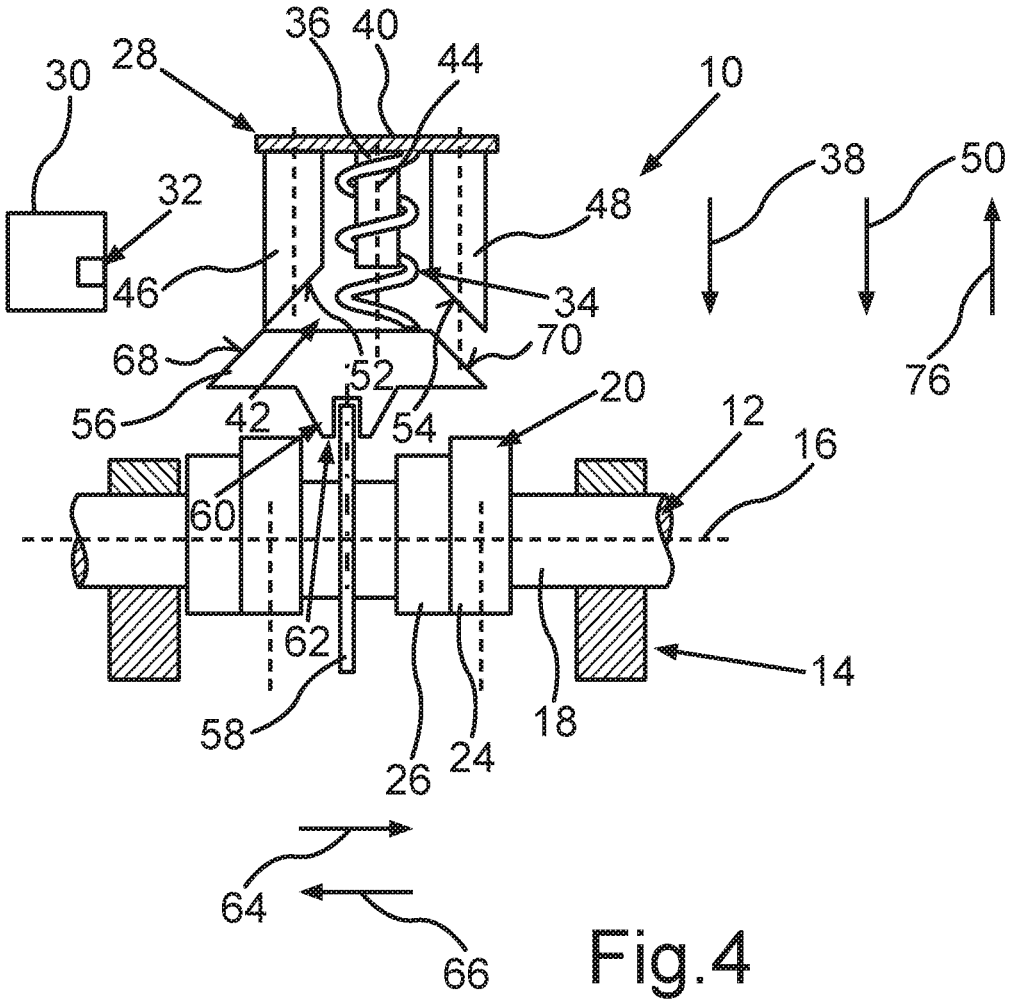
Figure 5:
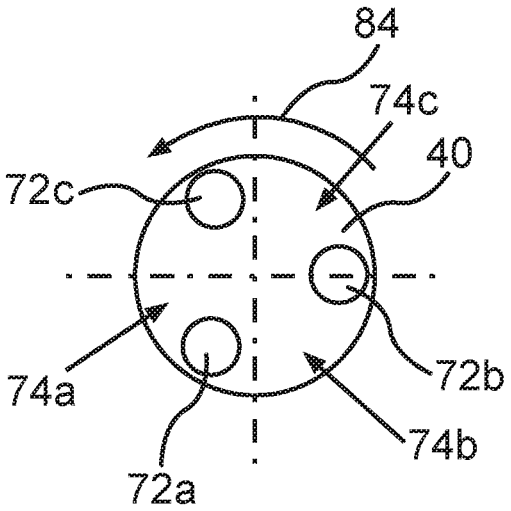

FIG. 4 sectionally, is a further schematic and partially cut side view of the valve drive device;

FIG. 5 is a further schematic top view of the control element; and

Figure 6:
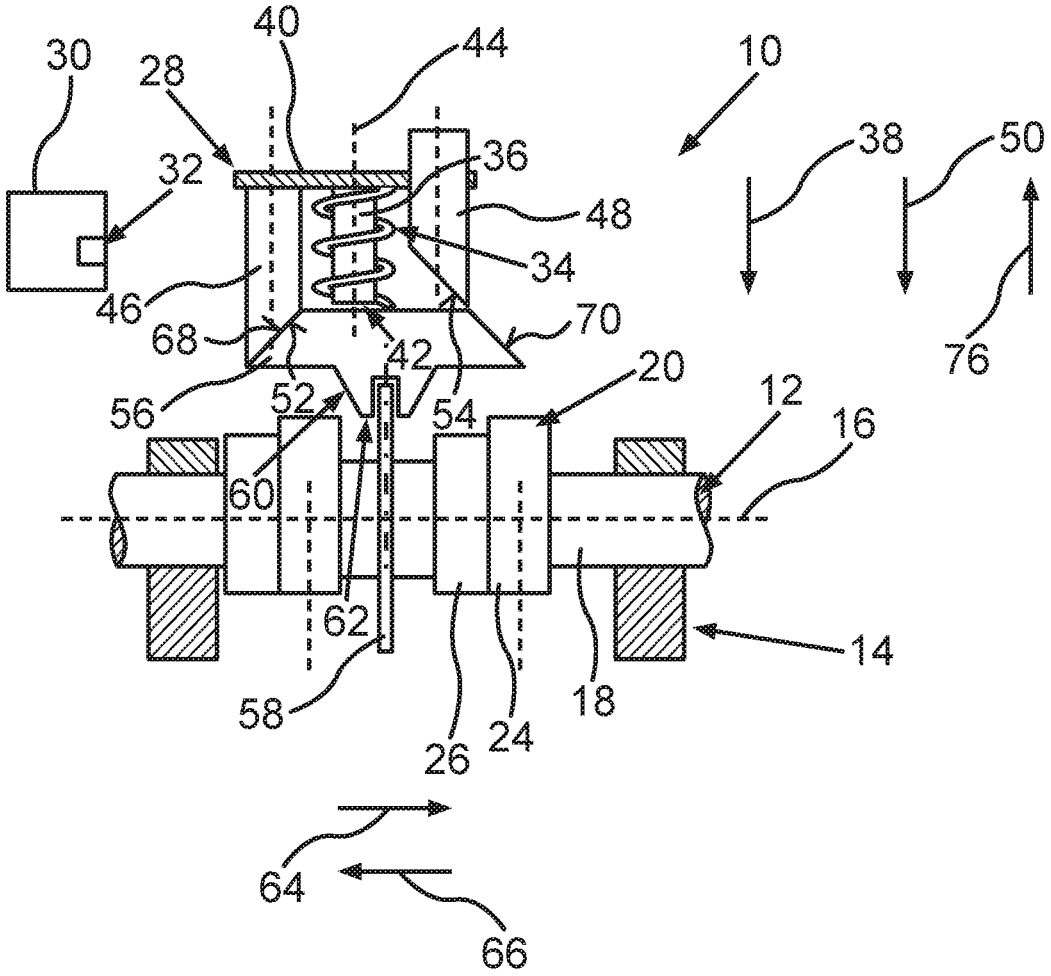

FIG. 6 sectionally is a further schematic and partially cut side view of the valve drive device.

DETAILED DESCRIPTION OF THE DRAWINGS

In the Figures, identical or functionally identical elements are provided with identical reference numerals.

Figure 1:
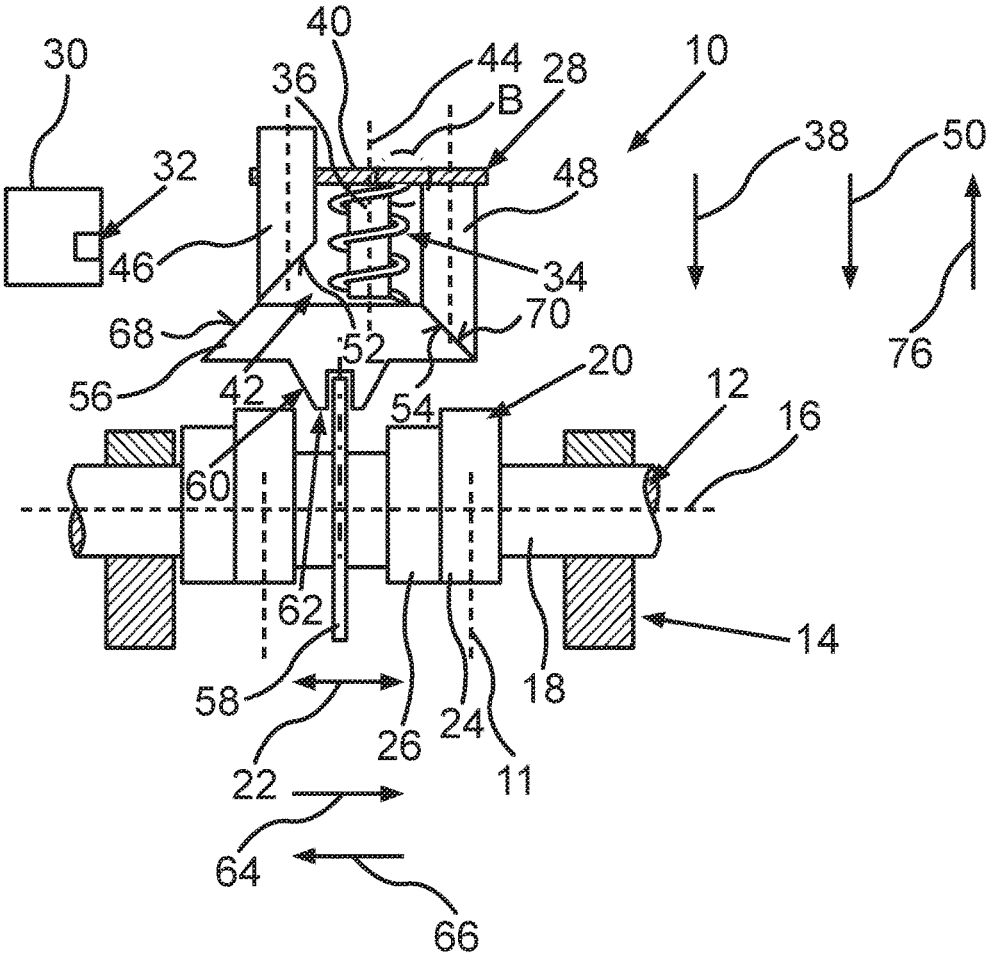

In a schematic and partially cut side view, FIG. 1 shows a valve drive device 10, in particular for an internal combustion engine. The internal combustion engine is designed, for example, as a reciprocating piston engine and is a component of a drive train of a motor vehicle, which is designed, for example, as a passenger vehicle, and can be driven by means of the drive train, in particular by means of the internal combustion engine. The internal combustion engine has at least one combustion chamber which is designed in particular as a cylinder and to which, for example, at least one valve designed as a gas exchange valve is assigned. The valve can be moved translationally between a closed position and several open positions and can—as will be explained in more detail below—be actuated by means of the valve drive device 10, which is simply also referred to as a valve drive, i.e., in particular can be moved translationally from the closed position into the respective open positions.

The valve drive device 10 comprises at least one camshaft 12, which for example is mounted on a bearing device 14 so as to be rotatable around a rotational axis 16 relative to the bearing device 14. The bearing device 14 is, for example, a housing of the valve drive device, wherein the housing can be, for example, a cylinder head or a cylinder head cover of the internal combustion engine. The internal combustion engine has, for example, an output shaft designed in particular as a crankshaft, which is coupled to the camshaft 12, for example via a control drive. The control drive can be designed as a chain drive, belt drive or gear drive, for example.

The camshaft 12 comprises a shaft element 18 and at least one cam piece 20 which can be driven by the shaft element 18 and is arranged, for example, on the shaft element 18. The cam piece 20, for example, is connected to the shaft element 18 in a rotationally fixed manner, but can be displaced in the axial direction of the camshaft 12 relative to the shaft element 18. The axial direction of the camshaft 12 coincides with the rotational axis 16, for example, and is illustrated in FIG. 1 by a double arrow 22. The cam piece 20 has at least one first cam 24 which causes a stroke of the first valve and at least one second cam 26 which causes a second stroke of the valve different from the first stroke. Here, the first stroke is greater than the second stroke. The cam piece 20 can be displaced in the axial direction of the camshaft 12 relative to the shaft element 18 between at least one first position shown in FIG. 1 and at least one second position shown in FIG. 6. In the first position, the valve can be actuated by means of the first cam 24. In the second position, the valve can be actuated by means of the second cam 26. In other words, when the cam piece 20 is in the first position shown in FIG. 1 and the camshaft 12 is driven and thereby rotated around the rotational axis 16 relative to the bearing device 14, the valve is actuated by means of the first cam 24. The valve is moved from the closed position to a first of the open positions, wherein the valve carries out the first stroke.

However, if the cam piece 20 is in the second position shown in FIG. 6 and if the camshaft 2 is driven and thus rotated around the rotational axis 16 relative to the bearing device 14, the valve is actuated by means of the second cam 26 and thus moved from the closed position into a second of the open positions. In doing so, the valve carries out the second stroke, which is shorter than the first stroke, such that, for example, the second open position lies between the first open position and the closed position. In the first position, the valve is not actuated by the second cam 26, wherein in the second position, the valve is not actuated by the first cam 24. In addition, FIG. 1 shows a valve axis 11, along which the valve can be moved translationally between the closed position and the open positions and is actuated by the respective cam 24 or 26 and thus moved translationally. The valve drive (valve drive device 10) further comprises an electrically controllable actuator 8, by means of which the cam piece 20 can be displaced relative to the shaft element 18 in the axial direction of the camshaft 12 as a result of a respective electrical control of the actuator 28. The valve drive further comprises an electronic control device 30 which is depicted particularly schematically in FIG. 1 and by means of which the actuator 28 can be electrically controlled or is electrically controlled within the scope of a method for operating the valve drive device 10. The respective electrical actuation is to be understood in particular as meaning that the actuator 28 is supplied with electrical energy or with electrical current during the respective electrical control, which is conducted into the actuator 28 or flows through it. This means that, during the respective electrical control, the actuator 28 is supplied with electrical energy from the control device 30.

In order to be able to move t cam piece 20 in a particularly space-saving and cost-effective manner and in a particularly functionally reliable manner, and thus to be able to implement a stroke changeover, also referred to as a valve stroke changeover, in a safe, space-saving and cost-effective manner, the actuator is designed to move the cam piece 20 alternately between the positions in the event of successive electrical actuations of the actuator 28 occurring with the same polarity. For this purpose, the control device 30 has exactly one output 32 for the actuator 28, via which the successive electrical actuations of the electrically operable actuator 28 with the same polarity occur. In other words, the control device 30 controls the actuator 28 only via exactly one output 32, in order to displace the cam piece 20 between the positions.

In the exemplary embodiment illustrated in the Figures, the actuator 28 is designed as a linear actuator, which has exactly one coil 34. The coil 34 can be supplied with electric current by the respective electrical control. In other words, the electric current with which the actuator 28 is supplied via the output 32 from the control device 30 flows through the coil 34. Since the electrical controls are always carried out with identical or the same polarity, the electric current flows in the electrical controls in each case in the same direction of current flow through the coil 34 and thus through the actuator 28.

The coil 34 is also referred to as magnetic coil, since by supplying the coil 34 with electric current, at least one magnetic field is generated and provided by the coil 34. Supplying the coil 34 with electric current is also referred to as energizing. If the respective electrical control ends, i.e., the energizing ends, no electrical current flows through the coil 34 between the end of the respective electrical control and before a start of the respective next electrical control, such that the coil 34 is not energized or is in an unenergized state.

In addition, the linear actuator (actuator 28) has exactly one armature 36, which can be translationally moved relative to the coil 34 by energizing the coil 34, i.e., by supplying the coil 34 with electric current, by means of the coil 34. The armature 36 is also referred to as a magnetic armature, which can be moved translationally by means of the magnetic field. In FIG. 1, an arrow illustrates a so-called armature direction in which the armature 36 is moved when the coil 34 is energized. By energizing the coil 34, the armature 36 is moved, for example, from a starting position shown in FIG. 4 to an actuating position shown in FIG. 1 and thereby in the armature direction (arrow 38). The armature direction runs in the direction of the camshaft 12 such that the armature 36 is moved in the direction of the camshaft 12 or in the direction of the cam piece 20 and thus towards the cam piece 20 when the armature 36 is moved from the starting position into the actuating position.

Figure 2:
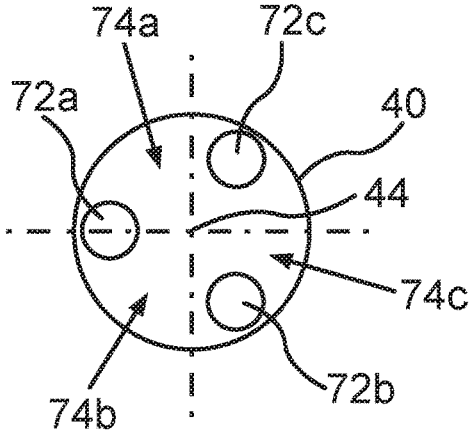
FIG. 2 is a schematic top view of a control element of the valve drive device.

The actuator 28 further comprises a control element in the form of a control disc 40, which is shown in FIGS. 2 and 5 in a respective top view. The control disc 40 is coupled to the armature 36 and is in particular attached to the armature 36. As a result, the control disc 40 with the armature 36 can be moved relative to the coil 34 and relative to the camshaft 12. If, for example, the armature 36 is moved in the armature direction (arrow 38) and thus, for example, from the starting position to the actuating position, the control disc 40 is also moved in the armature direction and thus from the starting position to the actuation direction. Thus the control disc 40 is also moved towards the cam piece 20. By way of example, the armature direction runs at least substantially perpendicularly to the axial direction of the camshaft 12.

The valve drive device 10 also comprises a forced guide 42, the function and components of which are explained in more detail below. By means of the forced guide 42, rotations of the control disc 40 resulting from translational movements of the control disc 40 and relative to the camshaft 12 around a rotational axis 44 can be effected. This means that the forced guide 42 converts, for example, translational movements of the control disc 40 around the rotational axis 44. The respective electrical control thus not only causes a translational movement of the control disc 40 from the starting position into the actuating position, but with the aid of the forced guide 42, the respective electrical control also results in a rotation of the control disc 40 around the rotational axis 44.

The actuator 28 comprises at least one first actuating element 46 and at least one second actuating element 48, which are designed as pins or as bolts in the present case, for example. The respective actuating element 46 or 48 can be moved translationally relative to the camshaft 12 along or in an actuating direction illustrated in FIG. 1 by an arrow 50. It can be seen from FIG. 1 that the actuation direction corresponds to the armature direction or runs parallel to the armature direction or coincides with the armature direction, wherein the actuation direction runs, for example, at least substantially perpendicularly to the axial direction of the camshaft 12. The control disc 40 alternately actuates the actuating elements 46 and 48 during its translational movements caused by the successive electrical controls and as a result of its rotations caused by means of the forced guide 42, whereby the actuating elements 46 and 48 are alternately moved translationally in the actuating direction relative to the camshaft 12 during the successive electrical controls, in particular moved towards the camshaft 12, such that the control disc 40 causes the alternating back and forth movement of the cam piece 20. This is also explained in more detail below. The first actuating element 46 has a first actuating surface 52, which runs obliquely to the actuating direction and obliquely, to the axial direction of the camshaft 12. The second actuating element 48 has a second actuating surface 54, which runs obliquely to the actuating direction and obliquely to the axial direction of the camshaft 12.

The valve drive device 10, in particular the actuator 28, comprises a sliding element in the form of a sliding carriage 56 which is displaceable in the axial direction of the camshaft 12 relative to the shaft element 18, by means of which the cam piece 20 can be moved back and forth between the positions relative to the shaft element 18. For this purpose, the cam piece 20 has, for example, a first positive-locking element 58, which is designed in particular as a disc and interacts, for example, positively with at least one second positive-locking element 60 of the sliding carriage 56. In this case, the positive-locking element 60 is designed as a receptacle or the positive-locking element 60 has a receptacle 62 in which the positive-locking element 58 engages. If, for example, the sliding carriage 56 is thus displaced relative to the shaft element 18 in a first sliding direction coinciding with the axial direction and illustrated in FIG. 1 by an arrow 64, the sliding carriage 56 takes the cam piece 20 with it, such that the cam element 20 is also displaced in the first sliding direction relative to the shaft element 18. If, in contrast, the sliding carriage 56 is displaced in a second sliding direction opposed to the first sliding direction and illustrated in FIG. 1 by an arrow 66 relative to the shaft element 18, the sliding carriage 56 takes the cam piece 20 with it such that the cam piece 20 is also displaced in the second sliding direction relative to the shaft element 18. By displacing the cam piece 20 in the first sliding direction, for example, the cam piece 20 can be displaced from the first position to the second position. By displacing the cam piece 20 in the second sliding direction, for example, the cam piece can be displaced from the first position to the second position.

Here, the sliding carriage 56 has a third actuating surface 68 corresponding to the first actuating surface 52, which runs obliquely to the actuating direction obliquely to the axial direction of the camshaft 12. In addition, the sliding carriage 56 has a fourth actuating surface 70 corresponding to the second actuating surface 54, which runs obliquely to the actuating direction and obliquely to the axial direction of the camshaft 12. The first actuating surface 52 is moveable by actuating the first actuating element 46 in supporting contact with the third actuating surface 68, whereby the sliding carriage 56 is displaced in the first sliding direction along the axial direction of the camshaft 12 relative to the shaft element 18, in order to cause a displacement of the cam piece 20 from the first position to the second position via the sliding carriage 56.

The second actuating surface 54 is moveable by actuating the second actuating element 48 in supporting contact with the fourth actuating surface 70, whereby the sliding carriage 56 is displaced relative to the shaft element 18 in the second sliding direction extending along the axial direction of the camshaft 12 and opposed to the first sliding direction, whereby a displacement of the cam piece 20 from the second position to the first position via the sliding carriage 56 is caused. When one of the actuating elements 46 and 48 is actuated by the control disc 40, the other actuating element 48 or 46, respectively, is not actuated by the control disc 40, such that the cam piece 20 is always pushed into only one of the sliding directions.

It can be recognized particularly well from FIGS. 2 and 5 that the control disc 40 has a plurality of recesses 72*a-c*, which are each designed as through-openings, for example. In the circumferential direction of the control disc 40, the recesses 72*a-c* are arranged one behind the other or one after the other and are spaced apart from one another, wherein the recesses 72*a-c* are evenly distributed in the circumferential direction of the control disc 40. In the exemplary embodiment illustrated in the Figures, the control disc 40 has exactly three recesses 72*a-c*, which, because the recesses 72*a-c* are evenly distributed in the circumferential direction of the control disc 40, are spaced apart in pairs by 120 degrees, in particular running around the rotational axis 44. In the circumferential direction of the control disc 40, respective wall regions 74*a-c* of the control disc 40 are arranged between the respective recesses 72*a-c*, wherein the wall regions 74*a-c* at least partially delimit the recesses 72*a-c* in each case.

FIGS. 1 and 2 show, for example, a first rotational position of the control disc 40, which can be rotated into the first rotational position by means of the forced guide 42. In the first rotational position, the recess 72*a* overlaps or overlays the actuating element 46. Furthermore, in the first rotational position, the wall region 74*c* overlaps or overlays the actuating element 48. If the armature 36 and with it the control disc 40 are then moved from the starting position into the actuating position and thus into the actuating direction or into the armature direction, the actuating element 46 dips into or through the recess 72*a*. In other words, the actuating element 46 is arranged in the recess 72*a*. Again expressed in other words, the actuating element 46 engages in the recess 72*a*, in particular in such a way that actuation of the actuating element 46 by the control disc 40 does not occur. The wall region 74*c*, however, comes into supporting contact with the actuating element 48 or the actuating element 48 is actuated by means of the wall region 74*c* and is thus moved in the actuating direction. As a result, the actuating surface 54 comes into supporting contact with the actuating surface 70, such that the actuating surface 54 slides on the actuating surface 70 or vice versa. As a result, the sliding carriage 56 and with it the cam piece 20 are displaced in the second sliding direction relative to the shaft element 18, whereby, for example, the cam piece 20 is pushed into the first position shown in FIG. 1, in particular starting from the second position.

If, for example, starting from the first rotational position shown in FIG. 2, the control disc 40 is rotated by 180 degrees around the rotational axis 44 relative to the camshaft 12, the control disc 40 will, for example, reach a second rotational position. In the second rotational position, the recess 72*a* overlaps or overlays the actuating element 48, and the wall region 74*c* overlaps or overlays the actuating element 46. If, for example, the armature 36 and with it the control disc 40 are then moved from the starting position into the actuating position and thus into the armature direction or into the actuating direction, the actuating element 48 dips into the recess 72*a* in such a way that the actuation of the actuating element 48 by the control disc 40 is not effected. The actuating element 46, however, is actuated by means of the wall region 74*c* and is thereby moved translationally in the actuating direction. As a result, the actuating surface 52 comes into supporting contact with the actuating surface 68, such that the actuating surface 52 slides on the actuating surface 68 or vice versa. As a result, the sliding carriage 56 and with it the cam piece 20 are displaced in the first sliding direction relative to the shaft element 18, whereby the cam piece 20 is displaced from the first position to the second position relative to the shaft element 18. By means of the forced guide 42, the control disc 40 is moved into respective rotational positions during its respective movements from the actuating position into the initial position, wherein in the respective rotational position, exactly one of the recesses 72*a-c* is in overlap with exactly one of the actuating elements 46 and 48 and exactly one of the wall regions 74*a-c* is in overlap with the respective other of the actuating elements 46 and 48. The first rotational position described above and the second rotational position described above belong to the rotational positions in which the control disc 40 can be rotated or is rotated by means of the forced guide 42. Thus, during a respective translational movement of the control disc 40 from the initial position into the actuating position, exactly one of the actuating elements 46 and 48 is actuated, while an actuation of the other actuating element 48 or 46 does not occur. In this way, the cam piece 20 can easily be moved back and forth.

The forced guide 42 comprises at least one spring element, which, in the present case, is formed by the coil 34. The spring element (coil 34), for example, is supported on the one side or on the one end at least indirectly, in particular directly, on the housing 14. On the other side or on the other end, the spring element is supported, for example, at least indirectly, in particular directly, on the control disc 40, The control disc 40 can be moved translationally relative to the housing along the armature direction or along the actuating direction. If the control disc 40 is now moved translationally along the armature direction and thus from the initial position to the actuating position, the spring element is tensioned. In the exemplary embodiment illustrated in the Figures, the spring element (coil 34) is compressed. The spring element is designed as a coil spring, for example, which is twisted or rotated by the tensioning or compression of the spring element. This means in particular that the respective ends of the spring element are rotated relative to one another, in particular around the rotational axis 44. The spring element is thus more strongly tensioned in the actuating position than in the starting position, such that the spring element provides a spring force at least in the actuating position which acts at least indirectly, in particular directly, on the control disc 40. After the end of the electrical control and before the start of the next electrical control, the spring element can be at least partially released, whereby the control disc 40 and with it the armature 36 are moved from the actuating position back to the starting position by means of the releasing spring element or by means of the spring force.

Figure 3:
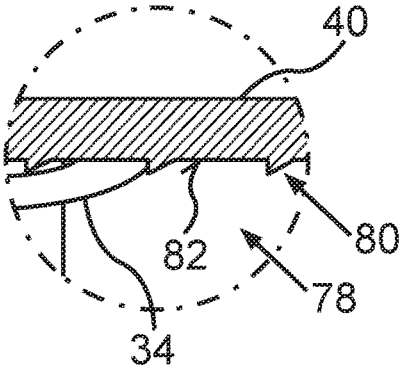
FIG. 3 is a schematic and enlarged depiction of a region of the valve drive device designated B in FIG. 1.

In this case, the control disc 40 and the armature 36 are moved translationally in a reset direction opposed to the armature direction or in a reset direction opposed to the armature direction or the actuating direction and illustrated in FIG. 1 by an arrow 76, in particular relative to the camshaft 12 and away from the camshaft 12. The reset direction is also referred to as reverse direction. When the spring element is released, the spring element turns back automatically. In other words, when the spring element is tensioned, its ends are rotated relative to each other in a first direction of rotation. When the spring element is released, the spring element automatically turns back in a second direction of rotation opposed to the first direction of rotation, such that the ends rotate relative to each other in the second direction of rotation opposed to the first direction of rotation. As a result, the spring element or the forced guide 42 causes the control disc 40 to rotate around the rotational axis 44, in particular in the second direction of rotation. A rotation of the control disc 40 in the first direction of rotation caused by the forced guide 42 does not occur, although the ends of the spring element are rotated relative to each other in the first direction of rotation when the spring element is tensioned, since the spring element is coupled to or interacts with the control disc 40, for example, via a freewheel device 78 which can be seen in FIG. 3 and is also referred to as a freewheel. The freewheel device 78 comprises a toothing 80, for example designed as micro-toothing, which is provided on the control disc 40, in particular on a side 82 of the control disc 40 facing the spring element (coil 34). Here, the side 82 is a broad side of the control disc 40 assigned to the spring element.

The stroke changeover which can be effected by means of the valve drive device 10 is explained in summary below: according to FIG. 1, the coil 34, for example, is first energized and thus tightens the armature 36 and the control disc 40 attached to it, such that the coil 34 or the magnetic field generated by the coil 34 holds the armature 36 and the control disc 40 in the actuating position against the spring force provided by the spring element. Since the control disc 40 has the recesses 72*a-c*, which are, for example, formed as slots, and the recess 72*a* overlaps with the actuating element 46, only the actuating element 48, which is for example formed as a transmission bolt, or is actuated by means of the control disc 40, while actuation of the actuating element 46, which is for example formed as a transmission bolt, effected by the control disc 40 does not occur. The cam piece 20 is in the first position, such that the valve is impinged upon or actuated by means of the cam 24.

FIG. 2 shows the first rotational position of the control disc 40, which assumes the first rotational position, for example in FIG. 1. Based on FIG. 1, the energization of the coil 34 is switched off, for example. Before the beginning of the next electrical control and thus before the beginning of the next energizing of the coil 34, the coil is thus de-energized, which is depicted in FIG. 4. Since the coil 34 acts as a spring element, the coil 34 lifts, for example, the control disc 40 after the end of the energization and before the beginning of the next energization and accepts, for example, the armature 36 magnetically held thereon and moves it from the actuating position into the starting position shown in FIG. 4. Due to the releasing of the coil 34 (spring element or coil spring) which takes place in this process and is also referred to as expansion, the ends of the coil spring rotate relative to each other in the second direction of rotation. Since one of the ends of the spring element is housing-fixed, i.e., fixed to the housing, the other end of the spring element rotates in the second direction of rotation relative to the one end, whereby the other end rotates the control disc 40 around the rotational axis 44 in the second direction of rotation relative to the camshaft 12 via the toothing 80, in particular if the actuating element 36 emerges from the recess 72*a* as a result of the movement of the control disc 40 in the direction of the initial position, whereby the control disc 40 is no longer guided via the recess 72*a* and the actuating element 46. This means, for example, that as long as the actuating element 46 engages in the recess 72*a*, the control disc 40 is secured against rotation around the rotational axis 44. If the actuating elements 46 and 48 are arranged completely outside the recesses 72*a-c*, the rotation of the control disc 40 around the rotational axis 44 in the second direction of rotation can be effected by the forced guide 42, in particular by the spring element. According to FIG. 4, the cam piece 20 is still in the first position such that the valve is still actuated by means of the first cam 24.

FIG. 5 shows, for example, a third rotational position of the control disc 40, wherein this third rotational position also belongs to the rotational positions into with the forced guide 42 of the control disc 40 can rotate. The rotation of the control disc 40 around the rotational axis 44 in the second direction of rotation is illustrated in FIG. 5 by an arrow 84. In the third rotational position, for example, the recess 72*b* overlaps with the actuating element 48, while the wall region 74*a* overlaps with the actuating element 46.

According to FIG. 6, the coil 34 is energized again, whereby the control disc 40 and the armature 36 are moved from the initial position shown in FIG. 4 to the actuating position. As the control disc 40 was previously rotated, the actuating element 48 now dips into the recess 72*b*, while the actuating element 46 is actuated by means of the wall region 74*a*. As a result, the actuating surface 52 comes into supporting contact with the actuating surface 68, whereby the sliding carriage 56 and with it the cam piece 20 are pushed in the first sliding direction.

Since one of the actuating elements 46 and 48 dips into one of the recesses 72*a-c* in each case during the respective movement of the control disc 40 from the initial position into the actuating position, the control disc 40 is secured against rotation around the rotational axis 44 during its movement from the initial position into the actuating position. In other words, the control disc 40 cannot rotate during its movement into the actuating position. However, the ends of the spring element are rotated relative to each other, but the other end of the spring element slides over at least one tooth of the toothing 80. This does not prevent the ends of the spring element from rotating relative to each other in the first direction of rotation. When the spring element is released, the other end comes, for example, into supporting contact with at least one tooth of the toothing 80, whereby the spring element can exert a torque on the control disc 40 via its other end when the spring element is released. By means of this torque, when the actuators 46 and 48 do not engage in the recesses 72*a-c*, the control disc 40 is rotated around the rotational axis 44 in the second direction of rotation. In this way, the control disc 40 can be successively rotated around the rotational axis 44 in the second direction of rotation from rotational position to rotational position by means of the forced guide 42, in which one of the recesses 72*a-c* of one of the actuating elements 46 and 48 and one of the wall regions 74*a-c* of one of the actuating elements 46 and 48 overlap in each case. In FIG. 6, it can be seen that the valve drive has been switched over such that the valve is now operated by means of the second cam 26.

On the whole, it can be seen that the actuator 28 is designed as an electromechanical linear actuator with only one coil 34 and only one armature 36. The armature 36 or the control disc 40 can actuate the two actuating elements 46 and 48, which are designed as bolts, for example. Each time the coil 34 is energized, the armature 36 is tightened. After the end of the energization and before the beginning of the next energization, the armature 36 or the control disc 40 performs a return stroke, in the scope of which the control disc 40 and the armature 36 move from the actuating position back to the starting position. During the return stroke, the control disc 40 is rotated by an angular amount and around the rotational axis 44 relative to the camshaft 12 via the forced guide 42, which is designed as a mechanism, for example, such that only one of the actuating elements 46 and 48 is actuated alternately in the successive electrical controls. The respective actuating element 46 or 48 presses, for example, on the sliding carriage 56, also referred to as the slide, in order to move the cam piece 20 by means of the slide.

LIST OF REFERENCE CHARACTERS

10 valve drive device
11 valve axis
12 camshaft
14 bearing device
16 rotational axis
18 shaft element
20 cam piece
24 first cam
26 second cam
28 actuator
30 control device
32 output
34 coil
36 armature
38 arrow
40 control disc
42 forced wide
44 rotational axis
46 actuating element
48 actuating element
50 arrow
52 actuating surface
54 actuating surface
56 sliding carriage
58 positive-locking element

60 positive-locking element
62 receptacle
64 arrow
66 arrow
68 actuating surface
70 actuating surface
72*a-c* recess
74*a-c* wall region
76 arrow
78 freewheel device
80 toothing
82 side
84 arrow

The invention claimed is:

1. A valve drive device (10), comprising:

a camshaft (12) which comprises a shaft element (18) and a cam piece (20) which is drivable by the shaft element (18) and which has a first cam (24) effecting a first stroke of a valve and a second cam (26) effecting a second stroke of the valve different from the first stroke and which is displaceable in an axial direction (22) of the camshaft (12) relative to the shaft element (18) between a first position, in which the valve is actuatable by the first cam (24), and a second position in which the valve is actuatable by the second cam (26);

an electrically controllable actuator (28) via which, as a result of an electrical control of the actuator (28), the cam piece (20) is displaceable relative to the shaft element in the axial direction (22) of the camshaft (12);

wherein the actuator (28) is configured to push the cam piece (20) alternately back and forth between the first and second positions in a case of successive electrical controls with a same polarity; and an electronic control device (30) which has exactly one output for the actuator (28) and via which the successive electrical controls of the actuator (28), which are carried out with the same polarity, take place;

wherein the actuator (28) is configured as a linear actuator which has a coil (34) which is supplyable with electrical current and one armature (36) which, by supplying the coil with electrical current, is moveable translationally relative to the coil;

wherein the armature (36) is coupled to a control element (40) which is moveable with the armature (36) in a translational manner relative to the coil (34);

wherein a forced guide (42), via which rotations of the control element (40) resulting from translational movements of the control element (40) around a rotational axis (44) can be effected;

wherein the actuator (28) has a first actuating element (46) and a second actuating element (48) which are each moveable in a translational manner along an actuating direction (50), wherein the control element (40), during its translational movements caused by the successive electrical controls and as a result of its rotations caused by the forced guide (42), alternately actuates the first and second actuating elements (46, 48), thereby alternately moving the actuating elements (46, 48) translationally along the actuating direction (50) and thereby causing the alternating back and forth movement of the cam piece (20).

2. The valve drive device (10) according to claim 1, wherein:

the first actuating element (46) has a first actuating surface (52) which runs obliquely to the actuating direction (50) and obliquely to the axial direction (22) of the camshaft (12); and the second actuating element (48) has a second actuating surface 54) which runs obliquely to the actuating direction (50) and obliquely to the axial direction (22) of the camshaft (12);

and further comprising:

a sliding element (56) displaceable in the axial direction (22) of the camshaft (12) relative to the shaft element (18) and via which the cam piece (20) is displaceable relative to the shaft element (18);

wherein the sliding element (56) has a third actuating surface (68) which corresponds to the first actuating surface (52) and which runs obliquely to the actuating direction (50) and obliquely to the axial direction (22) of the camshaft (12);

wherein the sliding element (56) has a fourth actuating surface (70) corresponding to the second actuating surface (54) and which runs obliquely to the actuating direction (50) and obliquely to the axial direction (22) of the camshaft (12);

wherein the first actuating surface (52) is moveable into supporting contact with the third actuating surface (68) by actuating the first actuating element (46), whereby the sliding element (56) is displaceable relative to the shaft element (18) in a first sliding direction (64) running along the axial direction (22) of the camshaft (12) in order to cause a displacement of the cam piece (20) from one of the positions to the other position via the sliding element (56);

wherein the second actuating surface (54) is moveable into supporting contact with the fourth actuating surface (70) by actuating the second actuating element (48), whereby the sliding element (56) is displaceable relative to the shaft element (18) in a second sliding direction (66) running along the axial direction (22) of the camshaft (12) and opposed to the first sliding direction (64) in order to thereby cause displacement of the cam piece (0) from the other position to the one position via the sliding element (56);

wherein when one of the actuating elements (46, 48) is actuated by the control element (40), the actuation of the respective other actuating element (48, 46) caused by the control element (40) does not occur.

3. The valve drive device (10) according to claim 2, wherein the control element (40) has a recess (72*a*) which is arranged in overlap with the first actuating element (46) in a first rotational position of the control element (40) rotatable into the first rotational position by the forced guide (42) and in overlap with the second actuating element (48) in a second rotational position of the control element (40) rotatable into the second rotational position by the forced guide (42).

4. The valve drive device (10) according to claim 1, wherein the forced guide (42) comprises the coil (34) designed as a spring element, which is tensionable by the respective translational movement of the control element (40) caused by the respective electrical control and is thereby rotatable in a first direction of rotation, relaxes between two successive ones of the electrical controls in each case, thereby independently turns back in a second direction of rotation (84) opposed to the first direction of rotation and thereby causes the control element (40) to rotate around the rotational axis (44).

* * * * *